US009385472B2

(12) United States Patent
Yen

(10) Patent No.: US 9,385,472 B2
(45) Date of Patent: Jul. 5, 2016

(54) CABLE CONNECTOR WITH RELEASING MEMBER

(71) Applicant: FOXCONN INTERCONNECT TECHNOLOGY LIMITED, Grand Cayman (KY)

(72) Inventor: Yu-Hung Yen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/676,839

(22) Filed: Apr. 2, 2015

(65) Prior Publication Data

US 2015/0288097 A1 Oct. 8, 2015

(30) Foreign Application Priority Data

Apr. 2, 2014 (TW) ..... 103205629 U

(51) Int. Cl.
*H01R 13/627* (2006.01)
*H01R 24/60* (2011.01)

(52) U.S. Cl.
CPC ..... *H01R 13/6275* (2013.01); *H01R 24/60* (2013.01)

(58) Field of Classification Search
CPC ..... H01R 13/6275; H01R 24/66
See application file for complete search history.

(56) References Cited

U.S. PATENT DOCUMENTS 6,976,865 B2 * 12/2005 Wu ..... H01R 13/6275 439/352
7,090,523 B2 * 8/2006 Shirk ..... G02B 6/4246 439/352
7,134,914 B1 * 11/2006 Wu ..... H01R 13/5804 439/357
7,666,023 B2 * 2/2010 Wu ..... H01R 13/6275 439/352
8,545,252 B2 * 10/2013 Wang ..... H01R 13/6275 439/352

FOREIGN PATENT DOCUMENTS

TW M422816 2/2012

* cited by examiner

*Primary Examiner* — Briggitte R Hammond
(74) *Attorney, Agent, or Firm* — Wei Te Chung; Ming Chieh Chang

(57) ABSTRACT

This invention provides a cable connector including a body and a releasing member. The body has a front side and a rear side opposite to the front side. The releasing member includes a base, a pressing portion bending and extending toward the rear side from the base, a bending portion extending toward the front side and bending downwardly from the base, a supporting portion bending and extending toward the front side from the bending portion and two extending portions extending toward the rear side from the two sides of the bending portion.

19 Claims, 5 Drawing Sheets

CABLE CONNECTOR WITH RELEASING MEMBER

BACKGROUND OF THE INVENTION

1. Field of the Invention

The present invention relates to a cable connector, and more particularly to a cable connector with a releasing member.

2. Description of Prior Arts

U.S. Pat. No. 8,545,252, published on Oct. 01, 2013 discloses a cable connector used for mating with a shell of a mating connector with an elastic blade. The cable connector includes a body and a releasing member mounted to the body. The body includes two side walls. The releasing member includes a driving arm sliding along the two side walls along a front-to-back direction and a bending portion extending backwardly and inwardly from the driving arm. However, it is not easy to produce such releasing member, it is not suitable for mass production.

A cable connector with improved releasing member is desired.

SUMMARY OF THE INVENTION

A cable connector locked with a shell of a mating connector comprises a body and a releasing member. The body has a front side and a rear side opposite to the front side. The releasing member mounted to the body comprises a plate portion fixed to the body, a bending portion extending backwardly and bending upwardly from a rear end of the plate portion and an operating portion bending and extending backwardly from the bending portion. The operating portion has a plurality of locking portions locked with the mating connector and a pressing portion connected with a rear end of the locking portions.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
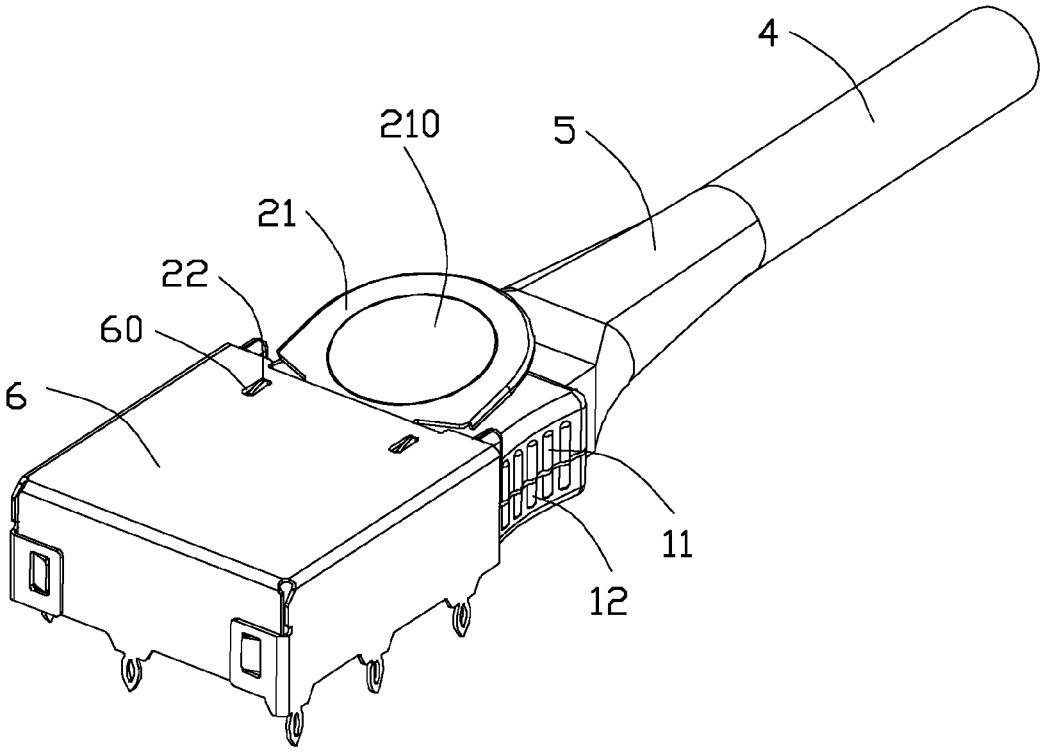
FIG. 1 is a perspective view of a cable connector cooperated with a mating connector in accordance with the present invention.
Figure 2:
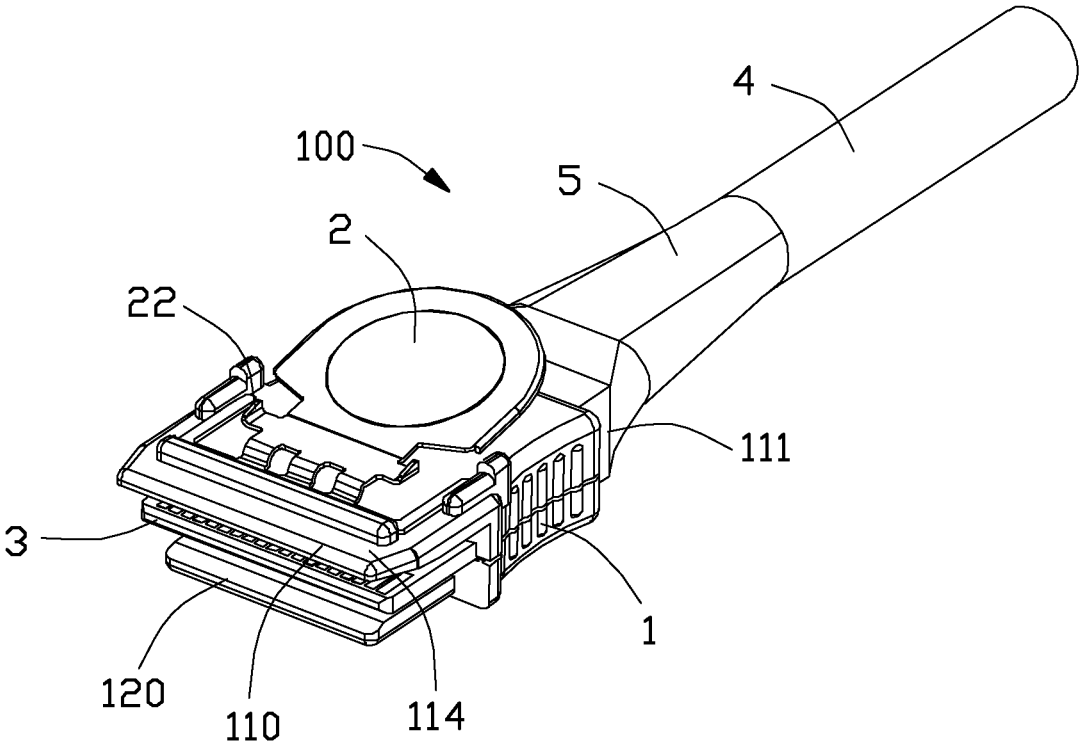
FIG. 2 is a perspective view of the cable connector as shown in FIG. 1.

Reference will now be made to the drawing figures to describe the present invention in detail.

FIGS. 1-5 show a cable connector 100 used for mating with a shell 6 of a mating connector with a locking slot 60. The cable connector 100 includes a body 1 and a releasing member 2 mounted to the body 1. The body 1 has a front side 110 used for mating with the shell 6 of the mating connector and a rear side 111 opposite to the front side 110, the front side 110 has a printed circuit board 3 for electrically connecting to the mating connector, the rear side 111 connects to a cable 4 with a plurality of fibers and a protective coat 5 covering the cable 4. The cable connector 100 is a photoelectric cable connector in this embodiment, the cable connector 100 also can be used as an electrical cable connector or a transceiver.

Figure 3:
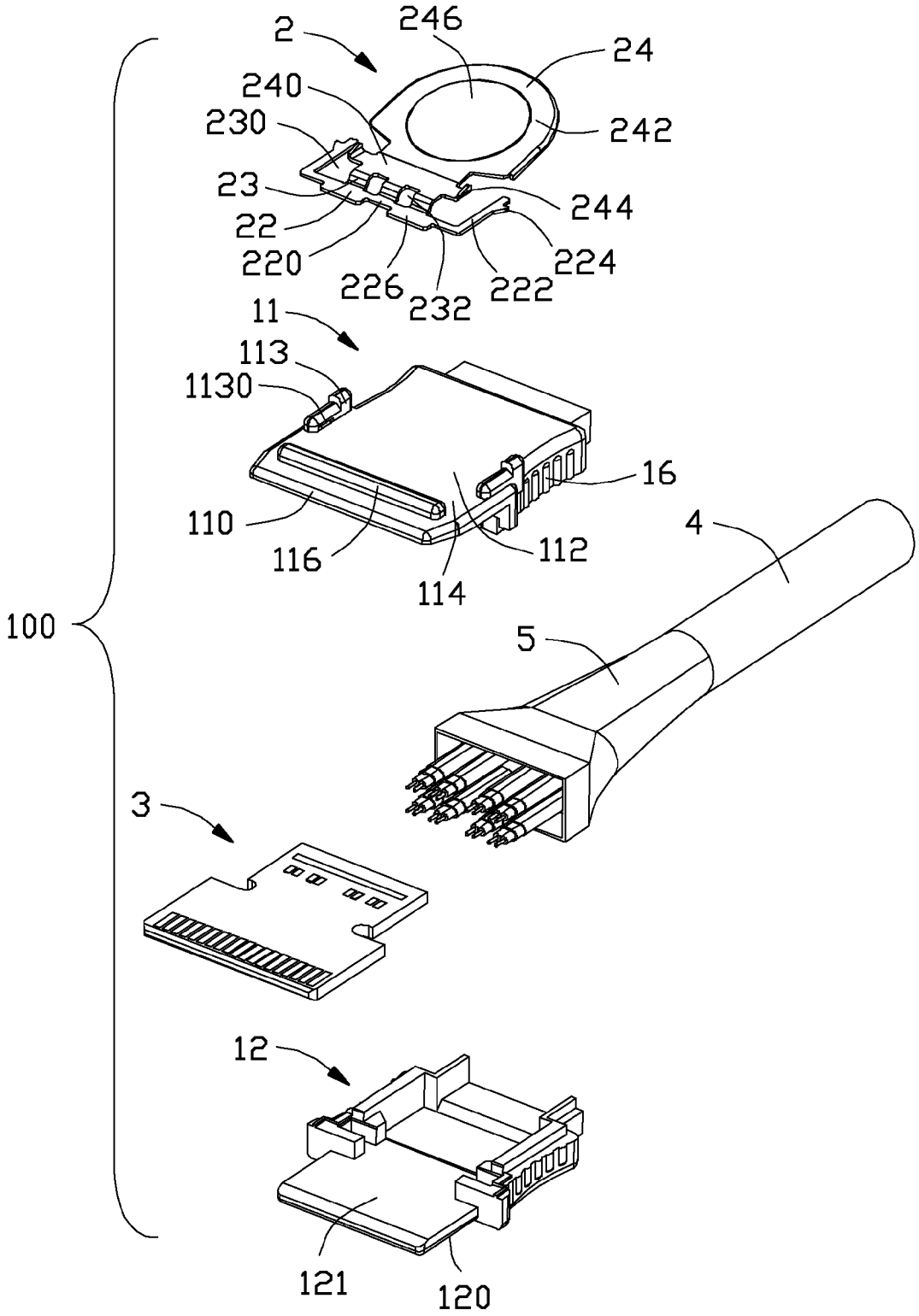
FIG. 3 shows an exploded view of the cable connector as shown in FIG. 2.
Figure 4:
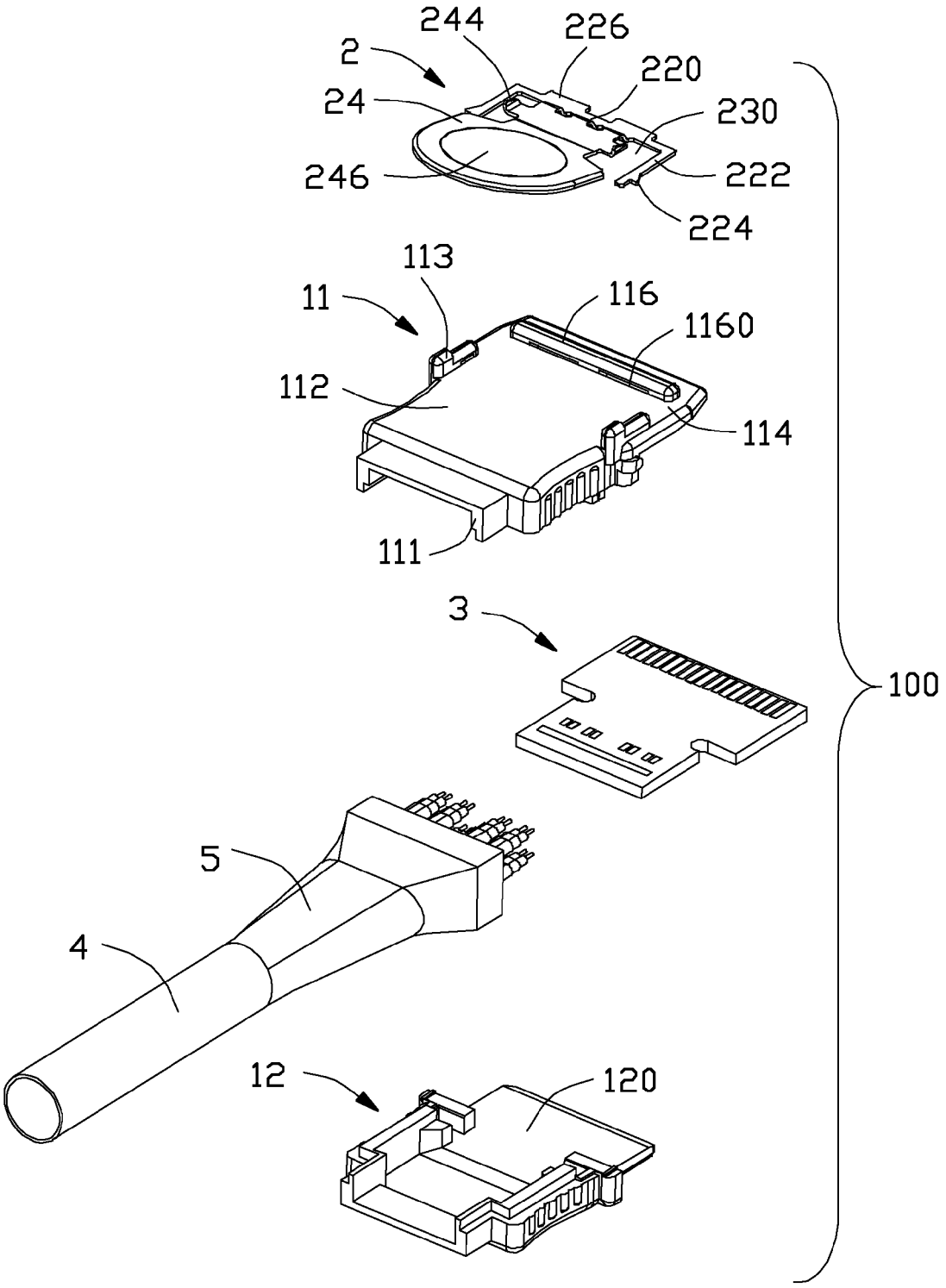
FIG. 4 shows another exploded view of the cable connector as shown in FIG. 2.
Figure 5:
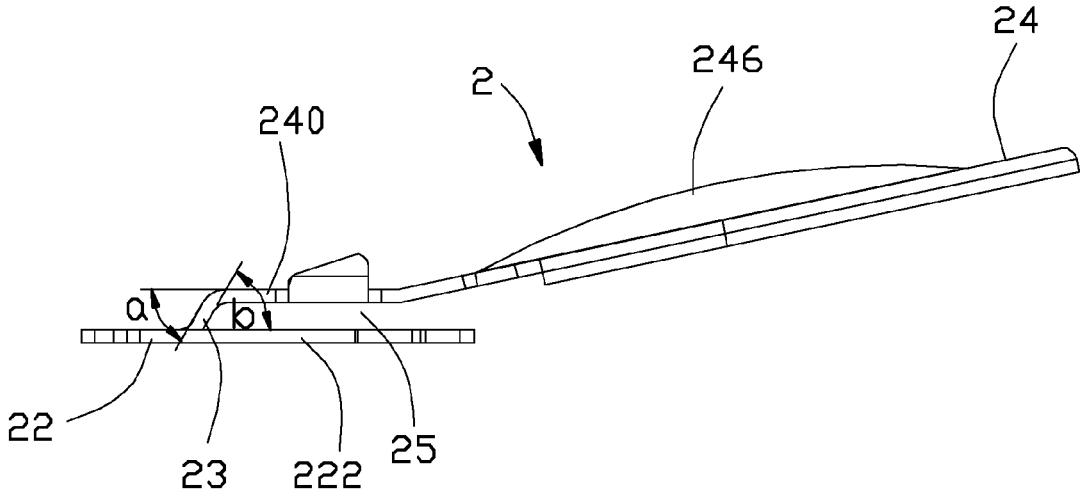
FIG. 5 shows a side elevational view of a releasing member of the cable connector.

Referring to FIGS. 3-4, the body 1 made of metal material includes an upper body 11 and a lower body 12 cooperated with the upper body 11. The body 1 has a top wall 112 formed on the upper body 11, a bottom wall 120 formed on the lower body 12, two side walls 16 connecting the top wall 112 and the bottom wall 120, a first tongue plate 114 extending from the top wall 112 and a second tongue plate 121 extending from the bottom wall 120. A width of the first tongue plate 114 is larger than a width of the second tongue plate 121. The upper body 11 and the lower body 12 each have a mating face. When the upper body 11 and the lower body 12 are mounted together, the mating face of the upper body 11 is overlapped with the mating face of the lower body 12. The upper body 11 and the lower body 12 are fixed together by a fix member (not shown) by riveting, soldering and screwing.

The upper body 11 has two aligned first tubers 113 each protruding upwardly from two side edges of the first tongue plate 114. The first tuber 113 has a first groove 1130 defined on an inner face and recessed outwardly. The first tongue plate 114 has a second tuber 116 protruding upwardly and located close to the front side 110 of the body 11, the second tuber 116 has two second grooves 1160 defined in a rear face thereof and recessed forwardly.

The releasing member 2 stamped by a metal sheet is mounted to the body 1. The releasing member 2 includes a plate portion 22, a bending portion 23 extending backwardly and upwardly toward the rear side 111 from the plate portion 22, an operating portion 24 further extending toward the rear side 111 from the bending portion 23. The plate portion 22 includes a supporting portion 220 connecting with the bending portion 23 and a pair of extending portions 222 respectively firstly extending toward two sides from the supporting portion 220 and then extending toward the rear side 111.

The operating portion 24 includes a base 240 connecting with the bending portion 23 and a pressing portion 242 bending and extending toward the rear side 111 from the base 240. The extending portion 222 and the bending portion 23 define a gap 230 along a horizontal direction. The releasing member 2 also has two locking portions 244 firstly extending toward two sides of the base 240 and then extending upwardly, the locking portion 244 is locked with the shell 6 of the mating connector. The locking portion 244 is shaped as a reverse triangle. The releasing member 2 has two second latching portions 224 extending toward two sides of the extending portion 222 and being shaped as a triangle, the second latching portion 224 is used for latching with the first groove 1130. The supporting portion 220 has a first latching portion 226 extending toward the front side 110 and being used for latching with the second groove 1160. The bending portion 23 is arranged intervally and the bending portion 23 defines a space/opening 232 therebetween, it meets the need of the molding process and can reduce a bear force of the bending portion 23. The base 240 and the extending portion 222 are parallel in different planes. The bending portion 23 bends downwardly from the base 240 by a first acute angle and the bending portion 23 bends downwardly by a second acute angle. The pressing portion 242 bends upwardly to increase an elasticity. The pressing portion 242 has an applying portion 246 to improve a feeling of an operator. The two extending portions 222 are disposed intervally and define a receiving space 25 with the base 240, the receiving space 25 is used for receiving the base 240 and the locking portion 244 when the pressing portion 242 is pressed.

The cable connector 100 is fixed with the releasing member 2 by the second latching portion 224 latched with the first groove 1130 and the first latching portion 226 latched with the second groove 1160. The cable connector 100 mates with the mating connector by the locking portion 244 of the releasing member 2 locked with a locking slot 60 of the shell 6 of the mating connector. The cable connector 100 is separate from the shell 6 of the mating connector by pressing the pressing portion 242 of the releasing member 2, then the locking portion 244 leaves from the locking slot 60. The releasing member 2 bends by a step form and two bending angles are all acute angles. Because of the bending angle is small, the work stations of stamping process are less. So, the production process is easy and this also can reduces the manufacturing cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector adapted for mating with a mating connector comprising:

a body has a front side and a rear side opposite to the front side; and a releasing member mounted to the body, the releasing member having a plate portion fixed to the body, a bending portion extending backwardly and upwardly from a rear edge of the plate portion and an operating portion further extending backwardly from the bending portion, the operating portion having a base with a plurality of locking portions for locking with the mating connector and a pressing portion connected with the base.

2. The cable connector as claimed in claim 1, wherein the plate portion has a supporting portion connected with the bending portion, two first latching portions extending forwardly from the supporting portion and two extending portions, the extending portions firstly extend outwardly from two sides of the supporting portion and then extend backwardly, the base is connected with the bending portion, and the pressing portion extends backwardly from the base.

3. The cable connector as claimed in claim 2, wherein the locking portions are disposed at two sides of the base, the locking portion is shaped as a reverse triangle.

4. The cable connector as claimed in claim 2, wherein the two extending portions are arranged intervally and have a receiving space with the base respectively, the receiving space is used for receiving the base when the pressing portion is pressed.

5. The cable connector as claimed in claim 1, wherein the body has a plurality of first tubers and a plurality of second tubers for cooperating with the releasing member, the first tuber has a first groove and the second tuber has a plurality of second grooves.

6. The cable connector as claimed in claim 2, wherein the releasing member has two second latching portions extending outwardly from two sides of the extending portion, the second latching portion is latched with the first groove, the first latching portion is latched with the second groove.

7. The cable connector as claimed in claim 5, wherein the body has an upper body and a lower body, the body has a top wall, a bottom wall, two side walls connecting the top wall and the bottom wall, a first tongue plate extending from the top wall and a second tongue plate extending from the bottom wall.

8. The cable connector as claimed in claim 7, wherein the first tuber protrudes upwardly from a side edge of the first tongue plate, the second tuber protrudes upwardly and is located close to the front side of the body, a first groove is defined on an inner face of the first tuber and recessed outwardly, a second groove is defined in a rear face of the second tuber and recessed forwardly.

9. The cable connector as claimed in claim 2, wherein the bending portion bends downwardly from the base in a first acute angle and the bending portion bends upwardly from the plate portion in a second acute angle.

10. The cable connector as claimed in claim 1, wherein the releasing member is stamped by a sheet material, the cable connector has a printed circuit board electrically connected with the mating connector.

11. A cable connector for mating with a mating connector comprising:

a body having a front side and a rear side opposite to the front side;

a releasing member mounted to the body, the releasing member having a plate portion fixed to the body, a bending portion extending backwardly and upwardly from a rear edge of the plate portion and an operating portion extending backwardly from the bending portion, the operating portion having a plurality of locking portions and a pressing portion; wherein the plate portion has a supporting portion connected with the bending portion and two extending portions, the two extending portions firstly extend outwardly from two opposite sides of the supporting portion and then extend backwardly, the operating portion has a base connected with the bending portion and the pressing portion, and formed with the locking portion.

12. The cable connector as claimed in claim 11, wherein the locking portions are disposed at two sides of the base, the locking portion is shaped as a reverse triangle.

13. The cable connector as claimed in claim 11, wherein the two extending portions are arranged intervally and have a receiving space with the base, the receiving space is used for receiving the base when the pressing portion is pressed.

14. A cable connector comprising:

a body having a mounting surface defined by a front-to-back direction and a transverse direction perpendicular to each other;

a releasing member mounted upon the mounting surface and including:

a U-shaped horizontal plate portion having a transversely extending supporting portion and a pair of extending portion extending rearwardly from two opposite ends of the supporting portion, each of said extending portion including a latching section to retain the releasing member to the body;

a bending portion upwardly and rearwardly extending from a rear edge of the supporting portion; and an operating portion including a base extending rearwardly from a rear end of the bending portion and equipped with a pair of upwardly extending locking portions on two opposite transverse sides of the base in said transverse direction, and a pressing portion upwardly and rearwardly extending obliquely from a rear end of the base; wherein said releasing member is derived and stamped from a metal sheet where the base is located between the pair of extending portions in said transverse direction.

15. The cable connector as claimed in claim 14, wherein the base is horizontal and parallel to said U-shaped horizontal plate portion.

16. The cable connector as claimed in claim 14, wherein the bending portion extends rearwardly with an acute angle.

17. The cable connector as claimed in claim 16, wherein said pressing portion extends rearward with another acute angle which is smaller than said acute angle.

18. The cable connector as claimed in claim 14, wherein the bending portion is located between the supporting portion and the extending portion along said front-to-back direction via a side view.

19. The cable connector as claimed in claim 14, wherein the bending portion forms at least an opening to lessen rigidity thereof.

* * * * *